US005444920A

United States Patent [19]

Nelson

[11] Patent Number: 5,444,920

[45] Date of Patent: Aug. 29, 1995

[54] TOOLS FOR USE IN DRESSMAKING

[76] Inventor: Sieglinde E. Nelson, 2149 Pineview Circle, Pensacola, Fla. 32526-8877

[21] Appl. No.: 139,259

[22] Filed: Oct. 20, 1993

[51] Int. Cl.[6] ..... B43L 7/00

[52] U.S. Cl. ..... 33/494; 33/11; 33/474

[58] Field of Search ..... 33/9 R, 11, 12, 13, 33/15, 16, 474, 476, 494, 562, 563, 565, 571

[56] References Cited

U.S. PATENT DOCUMENTS

| | | | |
|---|---|---|---|
| 321,986 | 7/1885 | Lewis | 33/11 |
| 825,915 | 7/1906 | Lesh et al. | 33/11 |
| 1,011,915 | 12/1911 | Carbonara | 33/11 |
| 1,158,425 | 11/1915 | Barnes | 33/11 |
| 1,214,296 | 1/1917 | Gorton | 33/11 |
| 3,639,988 | 2/1972 | Impastato | 33/11 |
| 4,345,383 | 8/1982 | Corsette | 33/474 |
| 4,672,748 | 6/1987 | Perazzolo | 33/11 |

*Primary Examiner*—William A. Cuchlinski, Jr.
*Assistant Examiner*—G. Bradley Bennett
*Attorney, Agent, or Firm*—Peter Loffler

[57] ABSTRACT

Tools for use in drafting projects such as dress making include a ruler having five scales, a five-in-one tool, and a tool having utility in the construction of darts. The five scale ruler enables its user to determine fractional lengths without resorting to arithmetic calculations. The five-in-one tool provides a 90°/45° angle, two scaled straight edges, a hip curve, a sleeve cap, neckline, and armhole curve, and a pair of spaced apart apertures for use in making Raglan sleeves. The dart tool is a forty five-forty five-ninety triangle having equidistantly spaced apertures formed along the length of the hypoteneuse. The apertures enable use of the tool as a compass for drawing circles and semicircles.

3 Claims, 3 Drawing Sheets

TOOLS FOR USE IN DRESSMAKING

BACKGROUND OF THE INVENTION

1. Field of the Invention

This invention relates, generally, to dressmaking tools. More particularly, it relates to a five scale ruler, a five-in-one tool, and a dart maker.

2. Description of the Prior Art

In the art of dress-making, there are five basic measurement units with which every dressmaker works: one-sixth inch, one-quarter inch, one-third inch, one-half inch, and one inch. Thus, rulers having those scales thereon are known, but dressmakers must purchase more than one scale to obtain all five of said basic scales.

A dressmaker is often called upon to calculate one-sixth of fourteen inches, one-quarter of thirty three inches, and the like. Thus, the dressmaker must resort to pencil and pad to calculate the answer, or resort to a calculator means.

Thus, there is a need for a scale that combines the five basic scales. More importantly, there is a need for a five-in-one scale that enables its user to calculate fractional parts of miscellaneous measurements without resorting to calculators or scratch pads.

There are also five basic tools every dressmaker must have: 1) a standard triangle having a ninety degree angle and a pair of forty five degree angles (a 45-45-90 triangle); 2) a compass; 3) a tool having armhole curves; 4) a tool having a hip curve; and 5) a straight edge. The latter three tools have heretofore been combined, but the art has failed to combine all five of these tools into one tool.

Thus, to get all five tools, dressmakers are currently required to purchase three tools. There is a need, then, for a tool that combines all five of these tools into a single tool. Significantly, the need has been longstanding, but heretofore no one has ever found a way to combine all of these tools.

Moreover, in the art of dressmaking, smaller tools are needed for the more intricate areas of a drafting project. For example, making construction darts require tools that are smaller and easier to maneuver than the tools heretofore known. Moreover, there is a need in dressmaking for a tool capable of making scallops and circles with a radius up to eleven inches.

Considering the prior art as a whole, at the time the present invention was made, it was not obvious to those of ordinary skill in this art how the needed five-in-one scale, the needed five-in-one tool, or the dart-making tool could be provided.

SUMMARY OF THE INVENTION

The novel five-in-one scale includes all five of the basic scales needed in dressmaking in a single tool. Just as importantly, it provides a means whereby the dressmaker or seamstress may calculate difficult fractional measurements without reliance upon external calculating means.

More particularly, where a dressmaker desires to calculate one-fourth of thirty-seven inches, for example, the answer is found by locating thirty-seven on the quarter inch scale, and reading the answer in inches on the inch scale.

The novel five-in-one tool is provided in the form of a 45-45-90 triangle (thereby providing a first tool) having its hypoteneuse formed into a scaled hip curve, (thereby providing a second tool), having a central opening that includes a scaled sleeve cap, neckline and armhole curve, (thereby providing a third tool), having two scales along its straight exterior edges (thereby providing a fourth tool), and having a Raglan sleeve-making tool with a three inch radius (thereby providing a fifth tool).

The dart-making tool is a small 45-45-90 triangle with means for making Raglan sleeves and skirts with up to an eleven inch radius. It can also be used for making circles and scallops (semicircles).

It will thus be seen that the primary object of this invention is to advance the dressmaking art by providing new tools that reduce the number of tools required for dressmaking and which simplify the arithmetic calculations that must be made when making articles of clothing.

More specific objects include the provision of a novel ruler having five scales, a novel tool that combines five tools into one tool, and a new dart-making tool.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
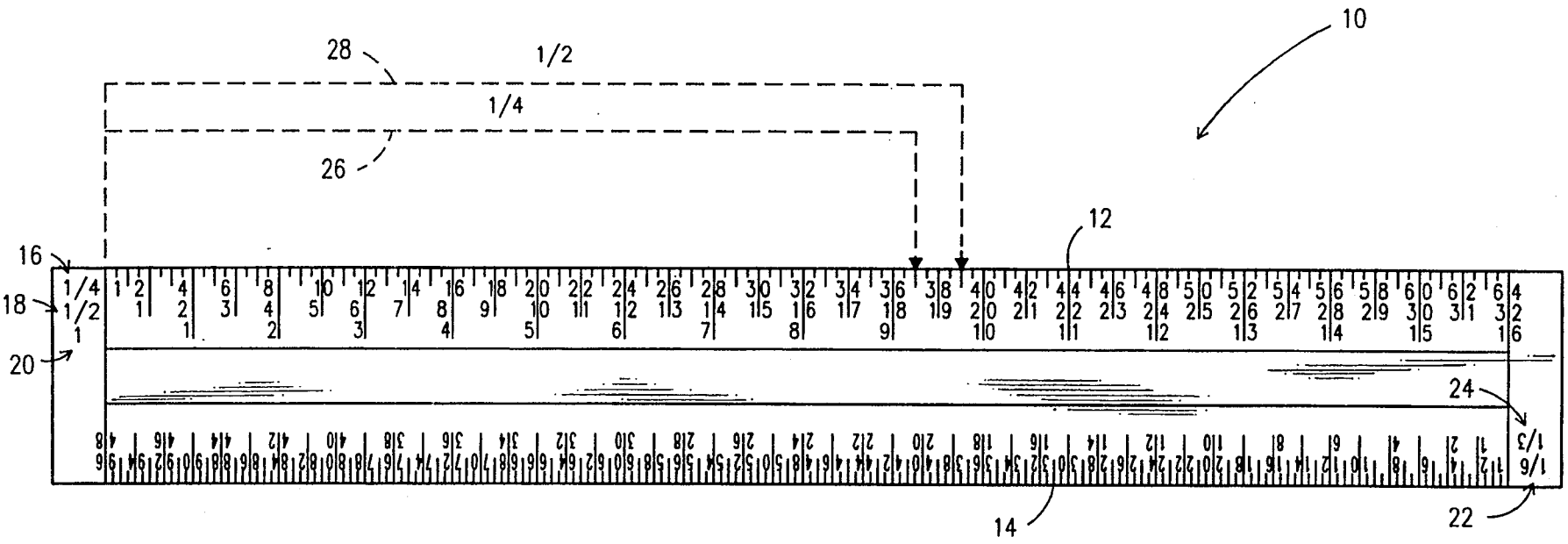
FIG. 1 is a top plan view of an exemplary embodiment of the novel five-in-one scale.

Referring now to FIG. 1, it will there be seen that an illustrative embodiment of the novel five-in-one scale is denoted 10 as a whole.

Ruler 10 includes a first straight edge 12 and a second straight edge 14; it is sixteen inches in length. A one-quarter inch scale 16 is disposed adjacent first edge 12, as is a one-half inch scale 18, and a one inch scale 20. Second edge 14 includes a one-sixth inch scale 22 and a one-third inch scale 24 as shown.

FIG. 1 also provides a couple of examples as to how the novel ruler is used. In the first example, the problem is to find one-fourth of thirty seven inches. As indicated in said FIG. 1, this problem is solved by finding thirty seven on the one-quarter inch scale 16 and reading the answer, nine and one-quarter inches, on the inch scale 20. In the second example, the problem is to determine one-half of nineteen and one-half inches. To find the answer, nineteen and one-half is located on the one-half inch scale 18, and the answer (nine and three-quarters inch) is read on the inch scale 20. Although the actual fractional inch measurement can be found on the 1" scale, there is no need to convert the final fractional amount back onto the 1" scale; instead, the number on the appropriate fractional scale is located and the pattern is marked up to that point.

In the same way, fractional amounts of any length up to ninety-six inches (see the one-sixth inch scale) are determined by simply looking up the starting length on the appropriate fractional scale.

Figure 2:
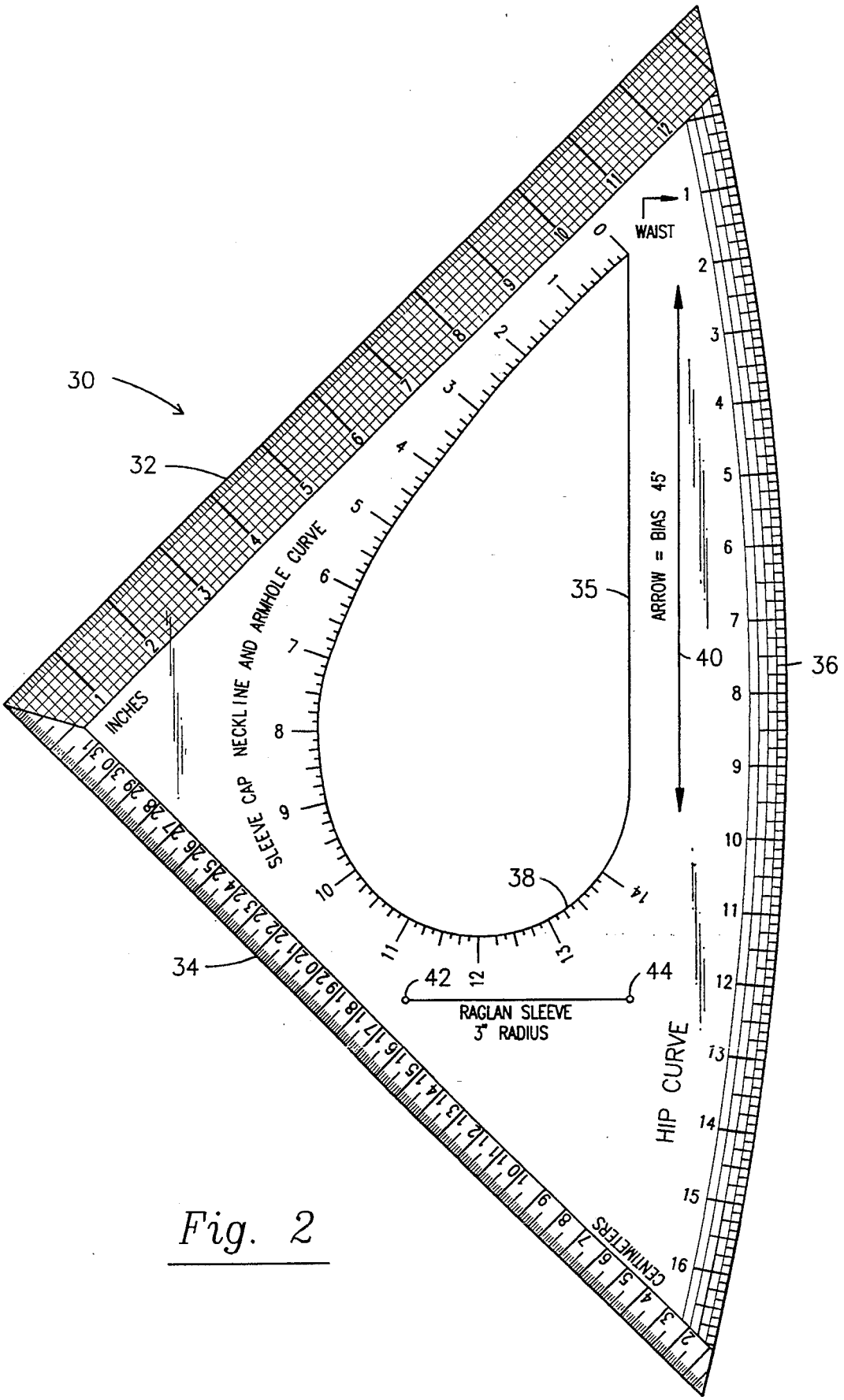
FIG. 2 is a top plan view of an exemplary embodiment of the novel five-in-one tool.

Making reference now to FIG. 2, it will there be seen that an illustrative embodiment of the novel five-in-one tool is a base member denoted 30 as a whole; note that it is a modified 45-45-90 triangle. It includes three edges 32 (inch scale), 34 (centimeter scale), and hypoteneuse 36 (inch scale); the modification referred to above is the convex arc formed in said hypoteneuse 36. The arc forms a hip curve of the type that may be purchased in prior art hip curve devices. A concave arc is also within the scope of this invention.

A central opening 38 formed in the base member 30 has a peripheral border of predetermined curvature that defines a sleeve cap, a neckline, an armhole curve, and a 45° angle. A bias line 40 is provided as well; it is disposed parallel to the 45° angle located on the straight side 35 of the central opening.

Moreover, a pair of apertures 42 and 44 are formed in the base member, radially outwardly of central opening 38, and are spaced three inches apart from one another; said apertures have utility in making Raglan sleeves, as those knowledgeable in this art will appreciate.

Thus, a total of five tools are combined in a single device: 1) a 90°/45° angle; 2) two straight edges with an inch scale 32 and centimeter scale 34; 3) a hip curve 36; 4) a sleeve cap, neckline, and arm hole curve 38; and 5) apertures 42, 44 which have utility in measuring the radius for construction of a Raglan sleeve.

Bias line 40 is disposed parallel to the straight side 35 of the central opening of the 5-in-1 tool as mentioned above. That straight side is used to draft a 45° angle.

Note that a forty-five degree angle is provided at 35 as aforesaid, thereby allowing tool 30 to serve as a 45-45-90 triangle.

Those of ordinary skill in this art know how to use these tools so no description of how to use them is required. This specialty tool was designed primarily for drafting dress patterns but can be used for a multitude of other projects as well, as those of ordinary skill will appreciate upon inspection thereof.

Figure 3:
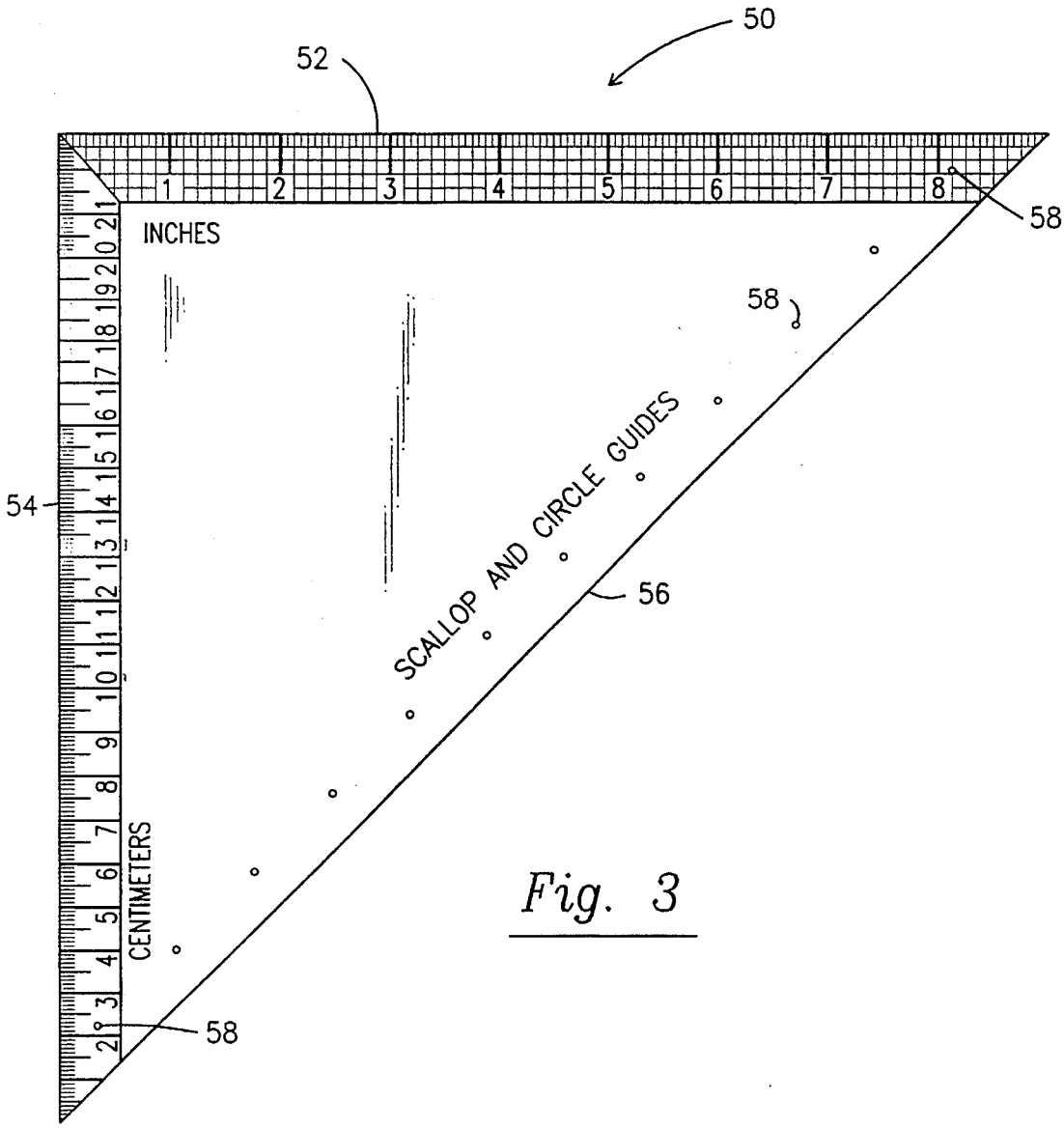
FIG. 3 is a top plan view of an exemplary embodiment of the novel dart making tool.

FIG. 3 illustrates the novel dart tool; it is a base member denoted 50 as a whole. It is a 45-45-90 triangle and includes sides 52 (inch scale), 54 (centimeter scale), and hypoteneuse 56. It is somewhat smaller than the five-in-one tool and is thus more suitable for use in small, intricate drafting projects. A plurality of equidistantly spaced apart apertures, collectively denoted 58, are formed in base member 50 and are spaced one inch apart from one another, in parallelism with hypoteneuse 56. This enables the drawing of circles and scallops when the instrument is used as a compass in the well-known way, i.e., a preselected aperture is used as a pivot point while a drawing instrument such as a pencil in another preselected aperture is rotated thereabout. Note that a skirt design requiring an eleven inch radius can be made with this tool. The use of dart tool 50 will be apparent to those of ordinary skill in this art, so no description of how it is used is required.

The owner of tools 10, 30, and 50 will have every tool required for dress making and many other projects as well. The tools are easy to use and greatly facilitate the projects with which they are used. Since they combine multiple functions, they are less expensive to purchase than the single function tools heretofore known. They eliminate the need for the user to perform arithmetical calculations and reduce the number of tools required to complete a job.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A drafting tool comprising:

a generally triangular base member having a pair of sides disposed at ninety degrees to one another and a hypotenuse having a predetermined curvature formed therein;

said predetermined curvature having utility in forming hip curves in dress patterns;

a first side of said pair of sides is a ruler means having an inch scale imprinted along the extent thereof;

a second side of said pair of sides is a ruler means having a centimeter scale imprinted along the extent thereof;

a central opening formed in said tool;

said central opening having a peripheral border of predetermined curvature;

said predetermined curvature providing a sleeve cap, neckline, and armhole curve;

a straight side formed in said central opening for construction of 45 degree angles and for locating fabric bias;

said straight side being disposed at a 45 degree angle from either straight edge of the triangle;

a pair of apertures formed in said tool, radially outwardly of said central apertures being spaced apart from one another by a predetermined distance to enable the construction of a Raglan sleeve.

2. The device as in claim 1 wherein said predetermined curvature is convex.

3. The device as in claim 1, further comprising a pair of apertures formed in said tool;

said pair of apertures being located radially outwardly of said central apertures and being spaced apart from one another by a predetermined distance to enable the construction of a Raglan sleeve.

* * * * *